US006336822B1

(12) United States Patent
Luzzoli

(10) Patent No.: US 6,336,822 B1
(45) Date of Patent: Jan. 8, 2002

(54) HANDLE OPERATED POWER CONNECTOR

(75) Inventor: Giorgio Luzzoli, Milan (IT)

(73) Assignee: Veam S.R.L., Milan (IT)

( * ) Notice: Subject to any disclaimer, the term of this patent is extended or adjusted under 35 U.S.C. 154(b) by 0 days.

(21) Appl. No.: 09/350,988

(22) Filed: Jul. 12, 1999

Related U.S. Application Data

(60) Provisional application No. 60/117,288, filed on Jan. 26, 1999.

(51) Int. Cl.[7] ..... H01R 13/62
(52) U.S. Cl. ..... 439/315; 439/314; 439/317
(58) Field of Search ..... 439/310–319

(56) References Cited

U.S. PATENT DOCUMENTS

| | | | | | |
|---|---|---|---|---|---|
| 3,892,458 | A | * | 7/1975 | Clark | 439/319 |
| 4,229,064 | A | * | 10/1980 | Vetter et al. | 439/68 |
| 4,239,314 | A | * | 12/1980 | Anderson et al. | 439/321 |
| 4,443,052 | A | * | 4/1984 | Eaby et al. | 439/322 |
| 4,477,022 | A | * | 10/1984 | Shuey et al. | 439/590 |
| 4,497,530 | A | * | 2/1985 | Shannon | 439/312 |
| 4,552,427 | A | * | 11/1985 | Landgreen | 439/316 |
| 4,743,207 | A | | 5/1988 | Clark | |
| 4,917,525 | A | * | 4/1990 | Duncan | 385/56 |
| 5,141,448 | A | * | 8/1992 | Mattingly et al. | 439/314 |
| 5,368,496 | A | | 11/1994 | Ranalletta et al. | |
| 5,558,533 | A | | 9/1996 | Hashizawa et al. | |
| 5,590,228 | A | * | 12/1996 | Gibola et al. | 439/587 |
| 5,627,448 | A | * | 5/1997 | Okada et al. | 439/133 |
| 5,628,644 | A | * | 5/1997 | Szalay et al. | 439/263 |
| 5,662,488 | A | * | 9/1997 | Alden | 439/314 |
| 6,071,148 | A | * | 6/2000 | Radliff et al. | 439/587 |

FOREIGN PATENT DOCUMENTS

| | | |
|---|---|---|
| EP | 0330128 A | 8/1989 |
| EP | 0921605 A | 6/1999 |
| GB | 869275 | 5/1961 |

* cited by examiner

*Primary Examiner*—Brian Sircus
*Assistant Examiner*—Son V. Nguyen
(74) *Attorney, Agent, or Firm*—Lowe Hauptman Gilman & Berner, LLP

(57) ABSTRACT

An electrical power connector is disclosed having a plug and receptacle. The plug includes a coupling ring having a single handle extending radially therefrom. The coupling ring is freely rotatable within limits on the plug when the plug is not coupled to the receptacle. The receptacle includes one or more bayonet ramps to which the coupling ring can be coupled. Advantageously, the plug can be coupled to the receptacle with 120° rotation or less by rotating the coupling ring 120° or less. The plug and receptacle each include a colored locking indicator to indicate to the person coupling the plug to the receptacle that the receptacle and plug are properly aligned to each other when coupled. Also an audible indication of locking is provided when the electrical plug and receptacle are fully coupled.

14 Claims, 4 Drawing Sheets

HANDLE OPERATED POWER CONNECTOR

RELATED APPLICATION

The present application claims priority from U.S. Provisional Application Serial No. 60/117,288 filed Jan. 26, 1999 entitled "Handle Operated Power Connector", and Design Application Serial No. 29/099,681 filed Jan. 26, 1999 entitled "Lever Operated Power Connector, the disclosures of which are incorporated by reference herein in their entirety.

FIELD OF THE INVENTION

The present invention relates generally to electrical connectors, and more particularly, to electrical power connectors.

BACKGROUND OF THE INVENTION

Electrical power connectors for connecting a receptacle and plug are known. These connectors are used in transit applications, power applications, light rail applications, tractor trailer trucks and buses, among other applications.

Power connectors, by virtue of their wire size, are inherently large and bulky. The cables used with power connectors are heavy and cumbersome. Traditional methods for coupling connectors of these types are via thread or bayonet coupling or locking levers. All are very difficult to implement as the contacts, due to their size, have very high insertion and extraction forces. The weight of the cable connector, its physical size, and its location on a panel or a vehicle make it very difficult to align and couple.

In many instances, to couple an electrical power connector becomes a two-man operation—one to hold and guide the plug and a second to activate the coupling mechanism. Bayonet or lever-lock is preferred over threads as the activation requires less movement of the coupling mechanism. A bayonet lock requires only a portion of a turn, but is difficult to accomplish because the entire plug has to be aligned with the receptacle and then the plug including cables has to be held in place while a coupling ring has to be rotated to effect mating between the plug and receptacle. A thread usually requires three or more turns. A lever connector is generally rectangular with two hasps on the side which need to be activated nearly simultaneously in order not to "cock" the plug into the receptacle.

Accordingly, a need exists in the art for an electrical power connector which requires less than one turn to couple. A further need exists for an electrical power connector in which coupling can be accomplished by a single person.

SUMMARY OF THE INVENTION

It is an object of the present invention to provide an electrical power connector in which the electrical connector can be coupled by a single person.

It is another object of the present invention to provide an electrical power connector in which coupling between a plug and receptacle requires less than 360° rotation of the coupling mechanism.

It is another object of the present invention to provide an electrical power connector in which a plug can be coupled to a receptacle in 120° rotation or less.

It is yet a further object of the present invention to provide an electrical power connector having a receptacle with a bayonet ramp and a plug having a coupling ring with a handle.

These and other objects of the present invention are accomplished by providing an electrical power connector having a plug and receptacle. The plug includes a coupling ring having a handle extending radially therefrom. The coupling ring is freely rotatable within limits on the plug when the plug is not coupled to the receptacle. The receptacle includes one or more bayonet ramps to which the coupling ring can be coupled. Advantageously, the plug can be coupled to the receptacle with 120° rotation or less by rotating the coupling ring 120° or less. The plug and receptacle each include a colored locking indicator to indicate to the person coupling the plug to the receptacle that the receptacle and plug are properly aligned to each other when coupled. Also an audible indication of locking is provided when the electrical plug and receptacle are fully coupled.

Advantageously, the coupling ring, with a handle, allows the user to hold and guide the connector with one hand and couple it with the other. The arrangement of the present invention limits the travel of the coupling ring and handle such that it can be easily located in the proper position for coupling. Once the connector is positioned for alignment—moving the handle in an arc of 90° to 120° allows the bayonet ramps to engage and supply the mechanical advantage to couple and uncouple easily. A clamping mechanism built into the panel or undercarriage, nests and holds the handle in place so it cannot be inadvertently uncoupled.

These and other objects of the present invention are achieved by an electrical power connector including a plug having at least one contact and a receptacle including a corresponding at least one contact. The receptacle has at least one ramp. The plug and the receptacle have an unmated condition and a mated condition. A coupling ring has a handle extending therefrom and includes at least one locking pin. A first stop and a second stop are each positioned in either the coupling ring and the receptacle such that said coupling ring is rotated less than 360° to move the connector from the unmated condition to the mated condition.

The foregoing and other objects of the present invention are achieved by an electrical connector including a plug having at least one male contact and at least one pin and a receptacle including a corresponding at least one female contact and at least one corresponding ramp for receiving the at least one locking pin. A handle is operatively associated with one of the plug and the receptacle and has a first surface and a second surface. A first surface and a second surface are each connected to one of the plug and the receptacle. The first surface and the second surface are circumferentially spaced from each other less than 360°. The plug and the receptacle are in an unmated condition when the first surface of the handle abuts the first surface. When the handle is rotated, the plug and the receptacle are brought into a mated condition when the second surface of the handle abuts the second stop.

The foregoing and other objects of the present invention are achieved by a method of coupling an electrical connector. The electrical connector includes a plug and a receptacle. The plug is aligned with the receptacle. The plug has at least one alignment key. The receptacle has a corresponding at least one keyway. A coupling ring is moved to a first circumferential position. The plug is mated to the receptacle when the coupling ring is rotated less than 360° to a second circumferential position.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by imitation, in the figures of the accompanying drawings, wherein elements having the same reference numeral designations represent like elements throughout and wherein.

BEST MODE FOR CARRYING OUT THE INVENTION

Figure 1:
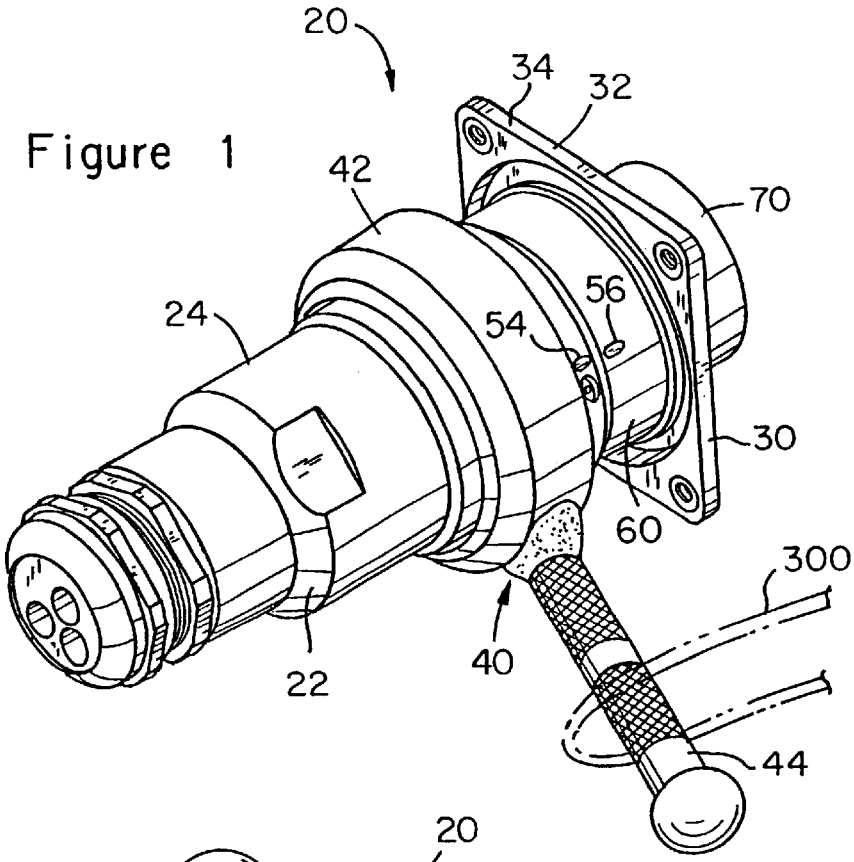
FIG. 1 is a perspective view of the lever operated power connector according to the present invention with a plug and a receptacle being shown in a coupled position.

Referring first to FIG. 1, a lever-operated electrical power connector, generally indicated at 20, is depicted in accordance with the principles of the present invention. Although the lever-operated electrical power connector is depicted in a horizontal orientation, it should be understood that the present invention is operable in any orientation and accordingly terms such as "left" and "right" as used herein are to be construed in the relative sense. The electrical power connector 20 includes a plug 22 and a receptacle 30. The plug 22 includes a cylindrical body 24. The receptacle 30 includes a cylindrical receptacle housing 32 which includes an outwardly extending rectangular flange 34 located at a central portion thereof. The receptacle 30 is fixedly secured via the flange 34 to a mounting surface such as on a truck, bus or train.

The plug 22 includes a collar assembly 40 including an annular coupling ring 42 having a radially outwardly extending handle 44 extending therefrom. The annular coupling ring 42 is freely rotatable on the body 24 within predefined limits as explained in detail below. The length of handle 44 can be selected depending upon the force required to effect connection between the plug 22 and the receptacle 30. Similarly, the amount of rotation of the handle 44 can be varied depending on the application between the plug 22 and receptacle 30. Also, any number of handles can be used. As depicted in FIG. 1, the electrical power connector 20 is shown in a coupled position with the plug 22 coupled to the receptacle 30. An alignment pin 54 extends outwardly from the annular coupling ring 42. A boss 56 acting as a protruding marker or indicator extends outwardly from the receptacle housing 32. As depicted in FIG. 1, pin 54 and boss 56 are aligned. The handle 44 is depicted in a coupled orientation. Pin 54 and boss 56 are preferably colored. A rear cylindrical portion 70 of receptacle 30 extends behind the mounting surface.

A locking mechanism 300 built into the panel or undercarriage of a vehicle such as a light rail car, can be moved into a position to nest and hold the handle 44 in place so it cannot be inadvertently uncoupled when the handle 44 is moved into the coupled position. This locking mechanism 300 can be of any known structure and can include a lock, for example, a key operated padlock for preventing malicious disengagement of the receptacle of the plug 22 and receptacle 30.

Figure 2:
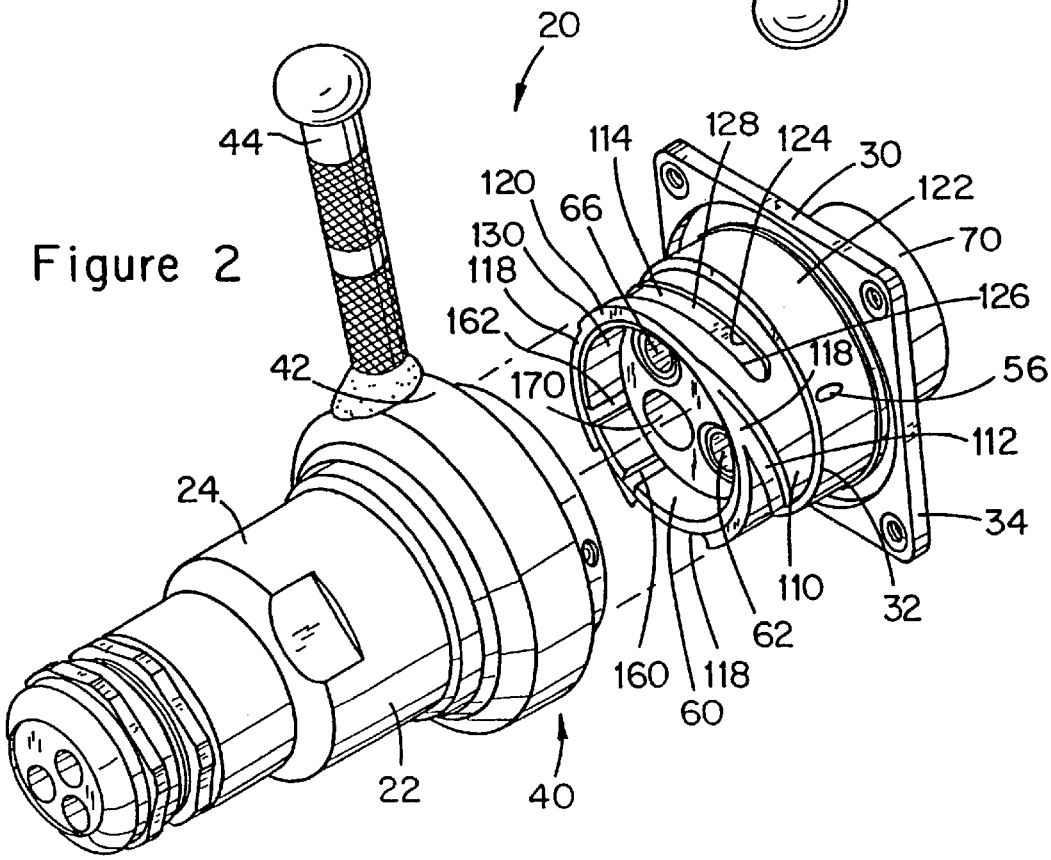
FIG. 2 is a side perspective view of the lever operated power connector of FIG. 1 with the plug and receptacle being shown in an uncoupled position.
Figure 3:
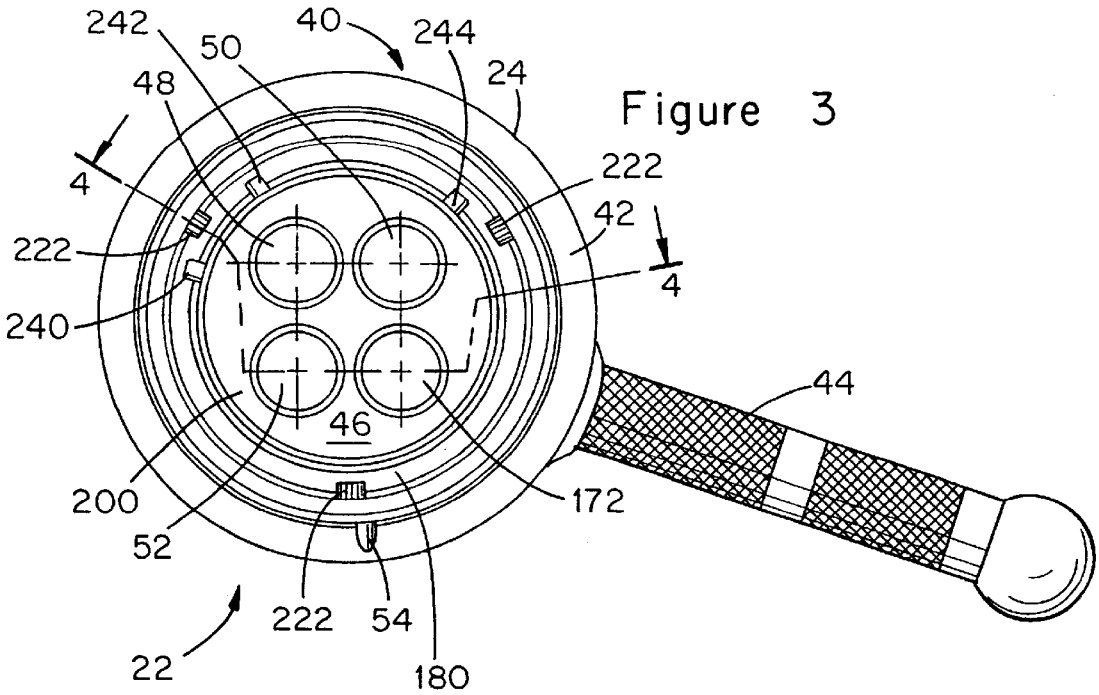
FIG. 3 is a front view of the plug and coupling ring according to the present invention.

Referring now to FIG. 2, the electrical power connector 20 is depicted with the plug 22 and receptacle 30 in an uncoupled position. In FIG. 2, the handle 44 is depicted in an uncoupled orientation. As depicted in FIG. 3, the plug body 24 includes a insulator 46 including three spaced male contacts 48, 50, 52 which are secured to the body 24 in a conventional manner such as by compression conformal fit. A fourth position 172 for a male contact is depicted and this position is not used in the depicted invention and is instead filled with a hole plug.

Returning to FIG. 2, the receptacle 30 includes a forward cylindrical portion or wall 60 and the rear cylindrical portion 70. The forward cylindrical portion 60 extends forwardly from the flange 34 for mating with the plug 22. The rear cylindrical portion 70 extends rearwardly from the flange 34 for connection to a backshell (not shown). The receptacle 30 includes three female contacts 62, 64 (see FIG. 7), 66 having corresponding positions to the contacts 52, 48, 50 in the plug 22. A fourth position 172 for a female contact is depicted which is not used in the depicted invention. Other contact configurations and number of contacts can be used with the subject matter of this invention. Also, the gender of the contacts can be reversed. The contacts 62, 64, 66 are secured to the receptacle 30 in a conventional manner such as by compression conformal fit. The mounting flange 34 includes four holes for bolting the flange to a vehicle such as a light rail car or to any other stationary mounting surface.

The forward cylindrical portion 60 includes three bayonet ramps 112, 114, 116 (see FIG. 2). Each bayonet ramp 112, 114, 116 has an opening 118 extending rearwardly from a forward surface 120 of the housing 30. Each of the bayonet ramps 112, 114, 116 spirals rearwardly from the forward surface 120 approximately 120° in the circumferential direction in a clockwise direction as depicted in FIG. 2. The ramps 112, 114, 116 must each spiral in the same direction although the ramps could also spiral in a counter clockwise direction. Each of the ramps 112, 114, 116 extends inwardly from an outer surface 122 of cylindrical portion 60 and each ramp has a rear surface 124, a front surface 126 and an outwardly facing surface 128. As depicted in FIG. 3, preferably three inwardly extending pins 222 in the collar assembly 40 ride in one or more of the bayonet ramps 112, 114, 116, respectively, and terminates its travel at a terminal end of bayonet ramp 112, 114, 116. Any number of ramps and pins could be used. The pins 222 are spaced at 120° apart and are press fit or staked into the annular coupling ring 42.

Figure 7:
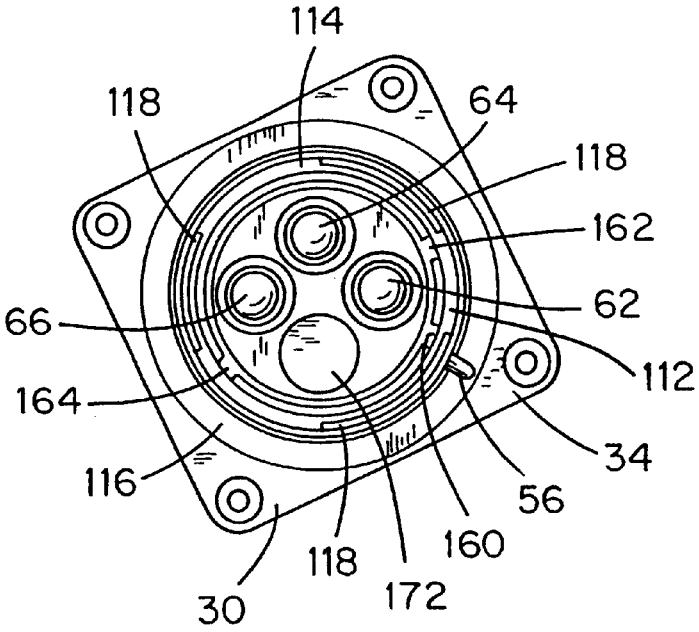
FIG. 7 is a front elevational view of the receptacle of the handle operated power connector of FIG. 1.
Figure 8:
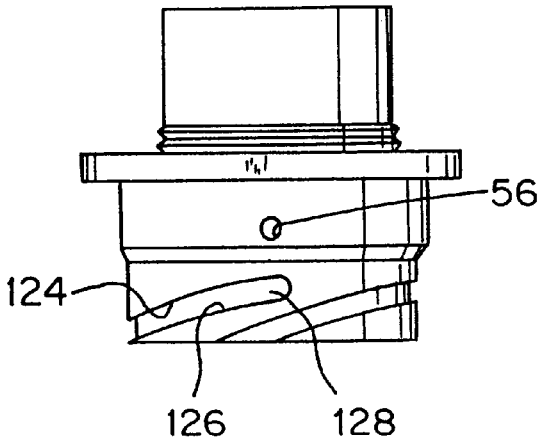
FIG. 8 is a top plan view of the receptacle of FIG. 1.

As depicted in FIG. 2, extending outwardly from an inner surface 130 of the cylindrical portion 60 are a plurality of keyways 160, 162, 164 (see FIG. 7). Keyways 160, 162, 164 provide alignment of the plug 22 to the receptacle 30. It should be understood that any number of keyways can be used in this application.

Figure 4:
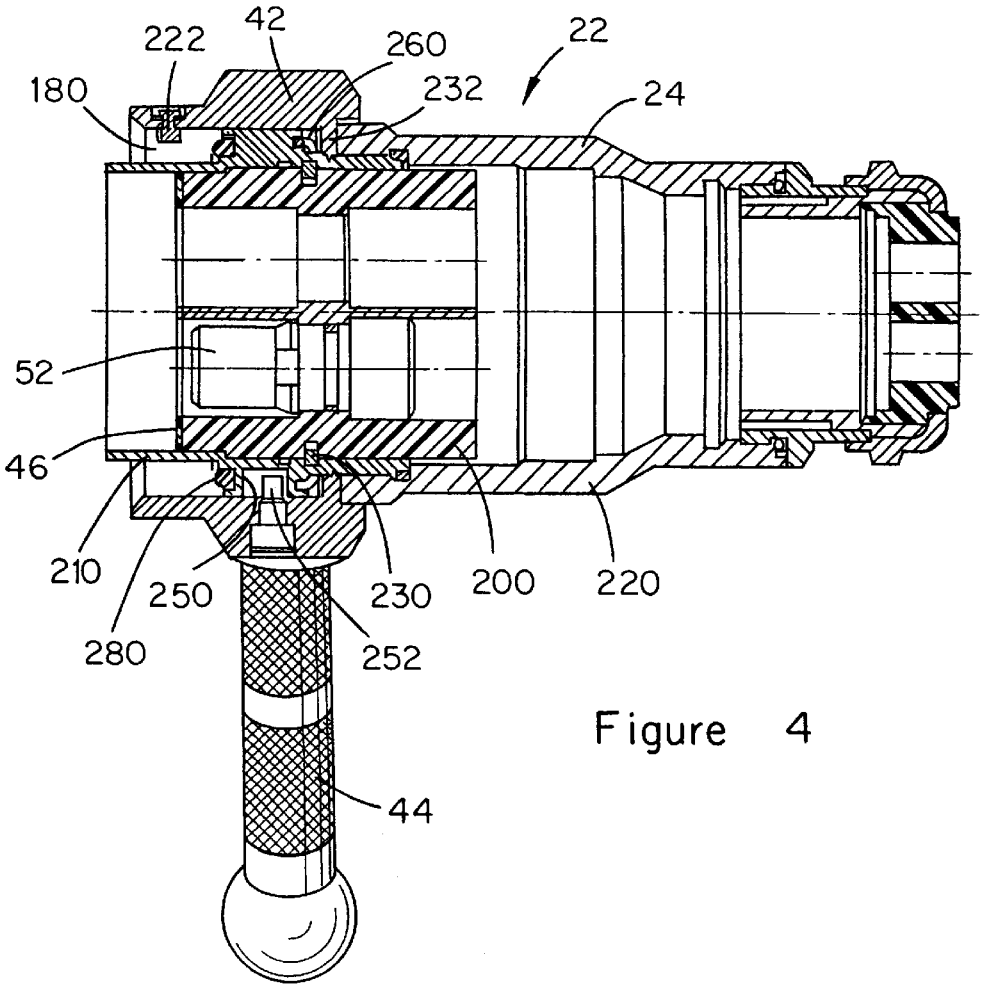
FIG. 4 is a side cross-sectional elevational view of the plug taken along lines 4—4 in FIG. 3.

Refer now to FIGS. 3 and 4 depicting the details of the plug 22. Plug 22 includes an electrically insulative central body portion 200, an intermediate portion 210 and an outer body portion or backshell 220. The backshell 220 can screw on to the rear cylindrical portion 70 The male contacts 48, 50, 52 are compression conformal fit into through bores of the central body portion 200. The central body portion 200 is located radially inwardly from intermediate portion 210 and is connected thereto using a snap ring 230. The outer body portion is threadedly engaged with the intermediate portion 210. The coupling ring 42 includes a shoulder 232 positioned between the intermediate portion 210 and the outer body portion for axially retaining the coupling ring 42.

As depicted in FIG. 3, pins 222 extend radially inwardly from annular coupling ring 42. As depicted in FIG. 4, an annular recess 180 is formed between forward most portions of the annular coupling ring 42 and the intermediate portion 210. Intermediate portion 210 extends forwardly relative to annular coupling ring 42.

As depicted in FIG. 3, three keys 240, 242 and 244 extend radially outwardly from intermediate portion 210 into the annular recess 180. Key 240 can be aligned with keyway 160, key 242 can be circumferentially aligned to keyway 162 and key 244 can be aligned with keyway 164 by rotating the body 24. Although keys 240, 242, 244 are depicted for use with the plug 22 and keyways for use with the receptacle, it should be understood that the keys and keyways could be reversed and other alignment means could also be used.

A circumferentially extending slot 250 is depicted in FIG. 4. An inwardly extending member 252 extends from the annular coupling ring 42 into the slot 250 as depicted in FIG. 4. The inwardly extending member 252 can be, for example, a set screw which is screwed into annular ring 42. Following the insertion of member 252 into the slot 250, the handle 44 can be welded onto the annular coupling ring 42 to prevent the inadvertent removal of member 252. A spring loaded clip 260 positioned between intermediate portion 210 and collar assembly 40 biases the coupling nut away from the receptacle 30 and the plug 22 forward to the receptacle 30 to guarantee a seal between plug 22 and receptacle 30 and to lock the pins 222 into the detents at the end of ramps 112, 114 and 116. It should be understood that positions of the slot 250 and the member 252 could be reversed. For example, the slot 250 could be in the coupling ring 42 and the member 252 could extend from the intermediate portion 210.

A seal 280, such as an O-ring can be positioned at the bottom of the annular recess 180 as depicted in FIG. 4. The surface 120 of the receptacle 30 is brought into sealing contact with the seal 280 thereby sealing the plug 22 and receptacle 30 from the environment. This is important because of the high voltage and/or current being used with the electrical connector 20.

Figure 5:
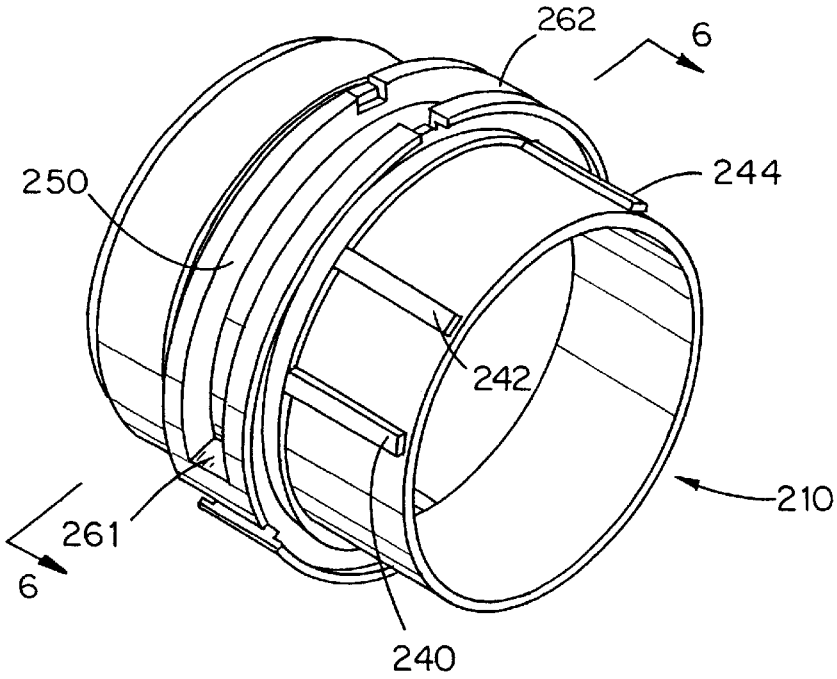
FIG. 5 is a perspective view of the intermediate portion of FIG. 4.
Figure 6:
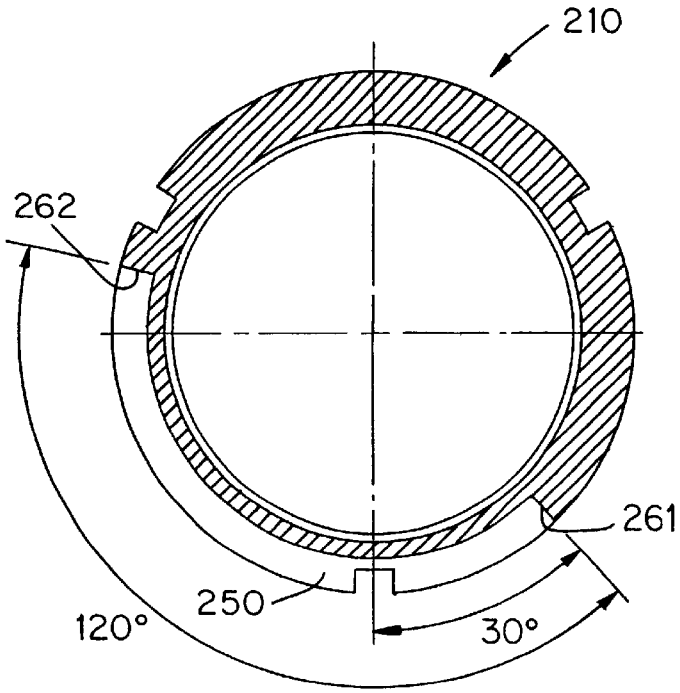
FIG. 6 is a cross-sectional view of the intermediate portion taken along lines 6—6 in FIG. 5.

Refer now to FIG. 5 where the intermediate portion 210 is depicted alone for clarity. As depicted in FIG. 5, intermediate portion 210 includes a centrally located slot 250. At opposite ends of slot 250 is a first stopper 261 and a second stopper 262. As depicted in FIG. 6, slot 250 preferably extends for an angle of 120° between the first stopper 261 and the second stopper 262 although any angle less than 360° can be used.

A side elevational view of the receptacle 30 is depicted in FIG. 7. A plurality of electrical connectors or contacts 48, 50, 52 are located within the plug 22. These contacts 48, 50, 52 are respectively coupled to one of the female contacts 62, 64, 66, respectively shown in FIG. 7.

In FIG. 4, the plug 22 is depicted. The pins 222 extend radially inwardly from an outer diameter of the coupling assembly 40 for engagement with bayonet ramps 112, 114, 116 (see FIG. 2).

In operation, the collar assembly 40 is rotated using the handle 44 to the counter-clockwise position depicted in FIG. 2. The plug 22 is brought into engagement with the receptacle 30 and the keys 240, 242, 244 are circumferentially aligned with one of the keyways 160, 162, 164, respectively. The coupling assembly 40 and the pins 222 are aligned with openings 118 of bayonet ramps 112, 114, 116 because the plug 22 is aligned with the receptacle 30. The handle 44 is then rotated clockwise 120° from the position depicted in FIG. 2 to the position depicted in FIG. 1. The pins 222 engage the front surfaces 126 and provide a camming action forcing the plug 22 into the mated position with the receptacle 30. The connector 20 provides an audible sound when the plug 22 is coupled to the receptacle 30. The male contacts 52, 48, 50 engage and frictionally mate with the corresponding female contacts 66, 64, 62. Although a clockwise rotation is depicted in FIGS. 1 and 2, the invention can also utilize ramps which would provide rotation in a clockwise direction.

Advantageously, the ramps 112, 114, 116 and pins 222 provide a camming action. The slot 250, pin 252 and surfaces 261, 262 limit the travel of the handle 44 to less than 360°, and preferably between 90° and 120°.

Alternatively, the coupling ring and bayonet ramps could be reversed and positioned on the receptacle 30 and plug 22, respectively.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An electrical power connector, comprising:

a plug including at least one first contact;

a receptacle including a corresponding at least one second contact, and at least one ramp, said plug and said receptacle having an unmated condition when said at least one first contact is disconnected from said at least one second contact, and a mated condition when said at least one first contact is connected to said at least one second contact;

a first stop and a second stop both positioned in said plug; and a coupling ring having a handle extending therefrom;

at least one pin for engaging with and being led by said at least one ramp of said receptacle; and a pin member for abutting said first and second stops such that said coupling ring is rotated less than 360° to move said connector from said unmated condition to said mated condition, wherein said coupling ring is freely rotatable about said plug within preset limits defined by said first stop and said second stop; and wherein said plug includes an electrically insulative central body portion and an intermediate portion, the central body portion receiving said at least one first contact therein and located radially inwardly from the intermediate portion so that the intermediate portion is radially located between the coupling ring and the central body portion, the first and second stops both positioned in the intermediate portion.

2. The electrical power connector of claim 1, further comprising a first alignment pin connected to said coupling ring and a second alignment pin connected to said receptacle wherein said first and second pins are circumferentially aligned when said plug and said receptacle are in said mated condition.

3. The electrical power connector of claim 1, wherein said receptacle is fixedly secured via a flange to a stationary mounting surface.

4. The electrical power connector of claim 1, wherein said receptacle has three ramps, each of which spirals rearwardly from a front surface of said receptacle, said front surface facing said plug when said plug and said receptacle are in said mated condition.

5. The electrical power connector of claim 1, further comprising alignment keys in said plug and alignment slots in said receptacle.

6. The electrical power connector of claim 5, wherein the alignment keys and the alignment slots are arranged asymmetrically circumferentially.

7. The electrical power connector of claim 1, wherein said at least one ramp faces radially outwardly and said at least one pin faces radially inwardly.

8. The electrical power connector of claim 1, further comprising a spring biasing said coupling ring in a direction away from said receptacle.

9. The electrical power connector of claim 1, wherein said at least one first contact is male and said at least one second contact is female.

10. The electrical power connector of claim 1, wherein said at least one pin is aligned with said at least one ramp when said plug and said receptacle are initially mated.

11. The electrical power connector of claim 1, further comprising a sealing element for isolating said at least one first contact and said at least one second contact from a surrounding environment when said plug and said receptacle are in said mated condition.

12. A method of coupling an electrical connector comprising a plug including at least one first contact;

a receptacle including a corresponding at least one second contact, and at least one ramp, said plug and said receptacle having an unmated condition when said at least one first contact is disconnected from said at least one second contact, and a mated condition when said at least one first contact is connected to said at least one second contact;

a first stop and a second stop both positioned in said plug; and a coupling ring having a handle extending therefrom;

at least one pin for engaging with and being led by said at least one ramp of said receptacle; and a pin member for abutting said first and second stops such that said coupling ring is rotated less than 360° to move said connector from said unmated condition to said mated condition, wherein said coupling ring is freely rotatable about said plug within preset limits defined by said first stop and said second stop; and wherein said plug includes an electrically insulative central body portion and an intermediate portion, the central body portion receiving said at least one first contact therein and located radially inwardly from the intermediate portion so that the intermediate portion is radially located between the coupling ring and the central body portion, the first and second stops both positioned in the intermediate portion, the method comprising the steps of:

aligning the plug with the receptacle using at least one alignment key and a corresponding at least one keyway;

moving the pin member of the coupling ring to a first circumferential position defined by said first stop; and rotating the coupling ring less than 360° to move the pin member of the coupling ring to a second circumferential position defined by said second stop, thereby mating the plug to the receptacle.

13. The method of claim 12, comprising using a bayonet mechanism to provide a camming action for mating the plug with the receptacle.

14. The method of claim 12, wherein the plug moves axially from said unmated condition to said mated condition without rotating the plug.

* * * * *